US005095569A

United States Patent [19]

Glenn

[11] Patent Number: 5,095,569

[45] Date of Patent: Mar. 17, 1992

[54] COVER SHEET FOR FACE DOWN PILLOW

[76] Inventor: Mary G. Glenn, 2818 W. Broad St., Richmond, Va. 23230

[21] Appl. No.: 793,151

[22] Filed: Nov. 18, 1991

[51] Int. Cl.[5] ..... A47G 9/04

[52] U.S. Cl. ..... 5/490; 5/470; 5/496; 5/482; 5/632; 5/638

[58] Field of Search ..... 5/490, 470, 482, 471, 5/431, 487, 496, 498, 435; D6/601, 602, 603, 596

[56] References Cited

U.S. PATENT DOCUMENTS

| | | | |
|---|---|---|---|
| D. 256,870 | 9/1980 | Britzman | 5/490 |
| D. 309,542 | 7/1990 | Glenn | 5/431 |
| 3,795,019 | 3/1974 | Fragas | 5/497 |
| 4,375,112 | 3/1983 | Leonhart | 5/490 |
| 5,027,457 | 7/1991 | Sweet | 5/490 |

*Primary Examiner*—Alexander Grosz
*Attorney, Agent, or Firm*—Norman B. Rainer

[57] ABSTRACT

A compliant cover sheet is provided for a face-down pillow which has a wedge shape and contains primary and secondary air passageways which facilitate breathing by the user of the pillow. The sheet is fabricated of a single piece of flat compliant thin material cut so as to have a perimeter edge configuration generally matching the configuration of the pillow. Intersecting slits adjacent the upper extremity of the sheet form triangular flaps which descend into the primary passageway. Fastening straps attached to the flaps are adapted to pass through the secondary air passageways and interengage edges of the sheet. A stabilizing strap attached across opposed edges of the sheet adjacent its lower extremity is adapted to embrace the pillow.

6 Claims, 2 Drawing Sheets

COVER SHEET FOR FACE DOWN PILLOW

BACKGROUND OF THE INVENTION

1. Field of the Invention

This invention relates to bedsheets, and more particularly concerns a fitted bedsheet adapted to cover a face-down pillow.

2. Description of the Prior Art

Numerous fitted sheets and pillow cases have been disclosed in the prior art for use upon a variety of mattresses and pillows. This invention, however, relates specifically to a face-down, wedge-shaped pillow as disclosed on U.S. Design Patent D302,542, issued to Glenn. Said wedge-shaped pillow, preferably constructed of polyurethane foam, is bounded by flat lower and upper surface emergent from a common posterior edge and extending divergently to an anterior extremity spaced about 3–4 feet from said posterior edge. At said anterior extremity, said lower and upper surfaces are spaced apart by about 8 inches, causing the angle between said upper and lower surfaces to be between about 5 and 12 degrees. The pillow is further bounded by generally triangularly shaped side surfaces, and a substantially rectangularly-shaped front surface. The pillow has a plane of symmetry orthogonally disposed to said lower surface and located equidistantly between said side surfaces. In a preferred embodiment, portions of the pillow adjacent the anterior extremity are tapered from said side surfaces inwardly toward the plane of symmetry and the front surface.

The anterior portion of the face-down pillow is provided with a primary air passageway centered upon said plane of symmetry and communicating between upper and lower surfaces. Secondary passageways communicate within the pillow with said primary passageway at its midpoint and extend orthogonally therefrom to openings in the front and side surfaces. In use, the person's face rests upon the primary air passageway on the upper surface. By virtue of the secondary passageways, the user is able to breathe normally because of the adequate ventilation provided by the several passageways.

Paired cavities may be recessed into the upper surface to accommodate women's breasts, and thereby provide greater comfort. Still other cavities may be provided in the upper surface to accommodate other anatomical features.

The above-described face-down pillow is not amenable to frequent washing. It is therefore desirable to have a washable compliant fabric case or cover that would protect the pillow and provide selective comfort to the user. However, a conventional slip-on type pillow case would cover all breathing, ventilation, and anatomical passageways, negating such beneficial features of the pillow. Even a simple top sheet for the pillow will not permit breathing through the passages and could not easily be maintained in overlying juxtaposition upon the pillow. Furthermore, a standard slip-on pillow case will not conform to the wedged shape and taper of the pillow, creating material waste and an aesthetically unappealing appearance.

It is therefore an object of the present invention to provide a covering device adapted to fit a face-down wedge-shaped pillow in close overlying conformity therewith.

It is another object of the present invention to provide a pillow cover of the aforesaid nature which will permit breathing through the passages of the associated pillow.

It is a further object of this invention to provide a cover of the aforesaid nature which may be secured in position upon the pillow.

It is yet another object of this invention to provide a cover of the aforesaid nature which is easily removed for frequent washing, is durable, aesthetically pleasing, and amenable to low cost manufacture.

These objects and other object and advantages of the invention will be apparent from the following description.

SUMMARY OF THE INVENTION

The above and other beneficial objects and advantages are accomplished in accordance with the present invention by a compliant cover sheet adapted for use upon a wedge-shaped face-down pillow comprised of a resilient wedge elongated between an anterior portion and a posterior extremity and bounded by upper and lower surfaces converging at said posterior extremity, opposed side surfaces of generally triangular shape, and a rectangularly shaped front surface extending between said upper and lower surfaces and terminating said anterior portion, said anterior portion having a substantially centered primary air passageway of rectangular cross-sectional contour communicating between said upper and lower surfaces, opposed transverse vent passages, each communicating between one of said side surfaces and said primary air passageway, and a longitudinal vent passage communicating between said primary air passageway and said front surface, said cover sheet comprised of a compliant thin material adapted to cover said upper surface in overlying juxtaposition and having:

a) a perimeter defined by forward and rear edges, paired parallel side edges emergent from said rear edge, and paired diagonal edges convergent between said side edges and said forward edge, said forward edge adapted to be disposed upon the front surface of said pillow and said rear edge adapted to associate with the posterior extremity of said pillow, b) perpendicularly bisecting slits in said sheet in overlying juxtaposition with said primary air passageway, said slits intersecting at a midpoint centered above said primary air passageway and defining forward, rear and paired side triangular flaps, each having an apex located adjacent said midpoint, said flaps adapted to hang within said primary air passageway, thereby defining a breathing aperture in said sheet bounded in part by four fold lines, each extending between two of the extremities of said slits and coinciding with the rectangular contour of said primary air passageway, c) paired fastening strap means for said side flaps, each strap means having a first extremity attached to said flap and a second extremity removably associated with a corresponding tapered edge of said sheet, said strap means adapted to be routed downwardly through said primary air passageway and out through one of the transverse vent passages to association with said tapered edge, d) forward flap fastening strap means elongated between a first extremity attached to said flap and a second extremity removably associated with the forward edge of said sheet, said strap means adapted to be routed downwardly through said primary air passageway and outwardly through said longitudinal vent passage to association with said forward edge, and e) lower stabilizing strap means elongated between extremities associated with each of said parallel edges and adapted to encircle said pillow adjacent and parallel to the posterior edge thereof.

In a preferred embodiment, additional flap type apertures are provided to be positioned above other depressions or passages in the pillow and allow passage of anatomical parts or medical apparatus. All edges and flaps may have an anti-ravel edge stitch associated therewith. In another preferred embodiment, said fastening strap means contain attachment means which may be in the form of hook and loop fastening strips such as VELCRO. Alternative attachment means include snap type fasteners and pressure-sensitive adhesive materials. The fastening strap means may be fashioned from elastic material in order to forcefully secure the position of the sheet.

The sheet may be fabricated from a linen or percale fabric or from similar fabrics of cotton, synthetic fiber or blends thereof. The sheet may also be comprised of paper or other nonwoven material. The perimeter of the sheet may be cut to slightly larger dimensions that the pillow to allow for the edges to overhang the pillow slightly.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
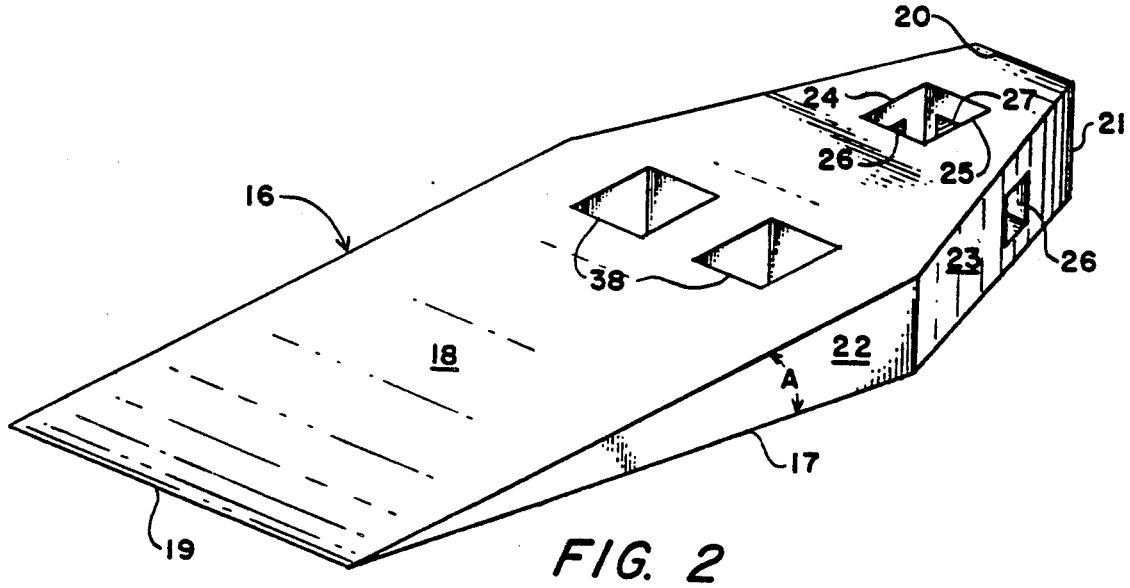
FIG. 2 is a top perspective view of a face-down wedge pillow prior to covering with the cover sheet of this invention.
Figure 3:
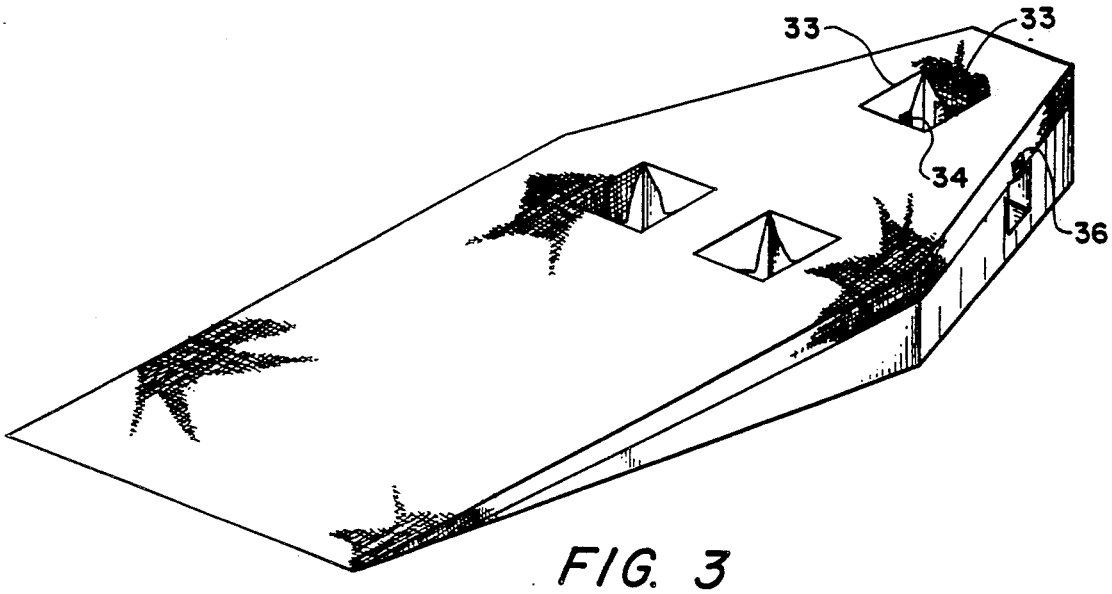
FIG. 3 is a top perspective view of the pillow of FIG. 2 shown covered with the cover sheet of this invention.
Figure 4:
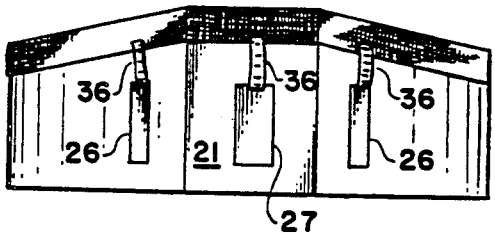
FIG. 4 is an anterior end view of the covered pillow of FIG. 3.

A face-down wedge-shaped pillow 16 which utilizes the cover sheet of the present invention, is shown in FIG. 2 as comprised of a piece of polyurethane foam bounded by flat lower and upper surfaces 17 and 18, respectively, emergent from a common posterior edge 19 and extending divergently to anterior extremity 20. At said anterior extremity, said lower and upper surfaces are spaced apart by upright rectangular front surface 21 of about 8 inches height. The angle A between said lower and upper surfaces is between about 5 and 12 degrees. The pillow is further bounded by generally triangularly-shaped side surfaces 22 and paired diagonal side surfaces 23 convergent from side surfaces 22 to front surface 21.

A primary air passageway 24 having a rectangular opening 25 in upper surface 28 is positioned adjacent anterior extremity 20. Opposed transverse vent passages 26 communicate between passageway 24 and diagonal side surfaces 23. A longitudinal vent passage 27 communicates between passageway 24 and front surface 21.

Figure 1:
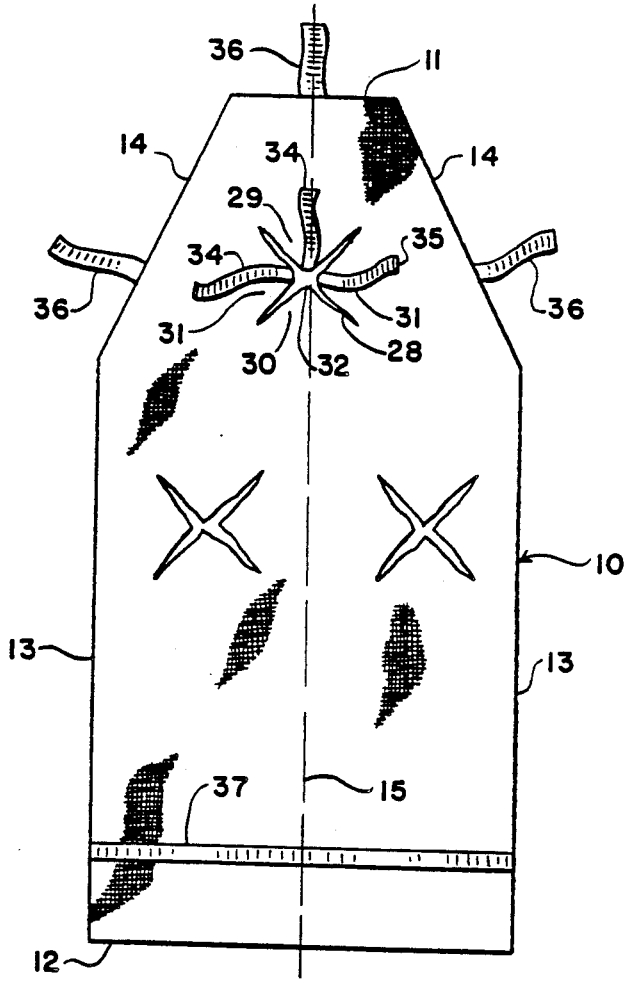
FIG. 1 is a bottom plan view of an embodiment of the cover sheet of the present invention.

As shown in FIG. 1, an embodiment of the cover sheet of the present invention is shown comprised of a substantially integral piece of a compliant thin material such as fabric 10 which may be of cotton, linen, or synthetic fibers or blends thereof in a woven construction. The cover sheet, whether of woven or non-woven construction is preferably comprised of hydrophilic fibrous material and is preferably moisture-permeable. Particularly preferred embodiments of the cover sheet are fabricated of inexpensive material which economically justify disposal after a single use. The piece of fabric has a perimeter defined by forward and rear edges 11 and 12, respectively, paired parallel side edges 13 emergent from said rear edge, and paired diagonal edges 14 converging between said side edges and forward edge 11. The sheet has a plane of symmetry, designated by broken line 15, which is perpendicular to the sheet and bisects said forward and rear edges.

Forward edge 11 is adapted to fold down upon front surface 21 of the pillow. Side edges 13 are adapted to fold down upon side surfaces 22 and 23 of said pillow. Rear edge 12 of the fabric is adapted to extend past posterior edge 19 of the pillow.

Perpendicularly bisecting slits 28 centered upon said plane of symmetry adjacent forward edge 11 define forward, rear and paired side triangular flaps, 29, 30, and 31, respectively, each having an apex 32 located at the intersection of said slits 28. Said flaps are adapted to hang downwardly with in primary air passageway 24, forming fold lines 33 extending between two contiguous extremities of opposite slits.

Fastening straps 34 are attached, as by sewing, to the apices 32 of said forward and side flaps 29, and 31 respectively, and extend to distal, free extremities 35. In the exemplified embodiment, each strap carries hook and loop attachment material, a suitable form being commercially available under the trademark VELCRO from the Velcro Corporation of New York. The fastening straps are of sufficient length such that the distal extremities can extend downwardly through primary air passageway 24 and laterally through the longitudinal and transverse vent passages. Interactive securing straps 36 sewn to forward and diagonal edges 11 and 14, respectively, contain VELCRO material adapted to interact with, and secure the distal extremities 35 of straps 34. Said interaction of fastening straps 34 with securing straps 36 causes the sheet to be drawn tautly against the pillow. In alternative embodiments, fastening straps 34 may contain other interactive attachment means such as snap fasteners and pressure-sensitive adhesive.

The cover sheet is further provided with an elastomeric strap 37 sewn to side edges 13 and disposed parallel to and adjacent rear edge 12. Strap 37 is adapted to embrace the pillow by crossing beneath it in taut association with lower surface 17.

The illustrated embodiment of pillow 16 is further shown to contain paired recessed 38 adapted to receive a woman's breasts for comfort purposes. The fitted sheet is correspondingly cut so as to avoid occlusion of recesses 38. In the illustrated embodiment, the nature of cutting of the sheet is in the form of crossed slits which create triangular tabs that enter the recess.

All edges of the cover sheet which have been cut so as to secure proper fitting are preferably served or otherwise treated to prevent unravelling of the fabric. In alternative embodiments, the cover sheet may be comprised of a non-woven sheet-like or film-like material which has no unravelling tendencies.

While particular examples of the present invention have been shown and described, it is apparent that changes and modifications may be made therein without departing from the invention in its broadest aspects. The air of the appended claims, therefore, is to cover all such changes and modifications as fall within the true spirit and scope of the invention.

Having thus described my intention, what is claimed is:

1. A compliant cover sheet adapted for use upon a wedge-shaped face-down pillow comprised of a resilient wedge elongated between an anterior portion and a posterior extremity and bounded by upper and lower surfaces converging at said posterior extremity, opposed side surfaces of generally triangular shape, and a rectangularly shaped front surface extending between said upper and lower surfaces and terminating said anterior portion, said anterior portion having a substantially centered primary air passageway of rectangular cross-sectional contour, opposed transverse vent passages, each communicating between one of said side surfaces and said primary air passageway, and a longitudinal vent passage communicating between said primary air passageway and said front surface, said cover sheet comprised of a piece of compliant thin material adapted to cover said upper surface in overlying juxtaposition and having:

a) a perimeter defined by forward and rear edges, paired parallel side edges emergent from said rear edge, and paired diagonal edges convergent between said side edges and said forward edge, said forward edge adapted to be disposed upon the front surface of said pillow and said rear edge adapted to associate with the posterior extremity of said pillow, b) perpendicularly bisecting slits in said sheet, said slits intersecting at a midpoint positioned to be centered above said primary air passageway and defining forward, rear and paired side triangular flaps, each having an apex corresponding to said midpoint, said flaps adapted to hang within said primary air passageway and thereby defining a breathing aperture in said sheet bounded in part by four fold lines, each extending between two contiguous extremities of said slits and coinciding with the rectangular contour of said primary air passageway, c) paired fastening strap means for said side flaps, each strap means having a first extremity attached to a side flap and a second extremity removably associated with a corresponding tapered edge of said sheet, said strap means adapted to be routed downwardly through said primary air passageway and out through one of the transverse vent passages to association with said tapered edge, d) forward flap fastening strap means elongated between a first extremity attached to said forward flap and a second extremity removably associated with the forward edge of said sheet, said forward flap fastening strap means adapted to be routed downwardly through said primary air passageway and outwardly through said longitudinal vent passage to association with said forward edge, and e) lower stabilizing strap means elongated between extremities associated with each of said parallel edges and adapted to encircle said pillow adjacent and parallel to the posterior edge thereof.

2. The cover sheet of claim 1 wherein attachment means are associated with said fastening strap means and corresponding edge of said sheet in a manner to facilitate rapid and secure engagement of said strap means with said sheet.

3. The cover sheet of claim 2 wherein said attachment means is selected from the group consisting of VELCRO hook and loop material, snap fasteners and pressure-sensitive material.

4. The cover sheet of claim 1 wherein said lower stabilizing strap means has elastomeric characteristics.

5. The cover sheet of claim 1 wherein said piece of compliant material is comprised of hydrophilic fibrous material and is permeable to moisture.

6. The cover sheet of claim 5 wherein said edges are treated to prevent unravelling.

* * * * *